US006283838B1

(12) United States Patent
Blake et al.

(10) Patent No.: US 6,283,838 B1
(45) Date of Patent: Sep. 4, 2001

(54) BURNISHING TAPE HANDLING APPARATUS AND METHOD

(75) Inventors: Elree Blake, San Jose; Shaun H. Chen, Cupertino; Daniel K. Walsh, Fremont; Scott M. Hipsley, Felton, all of CA (US)

(73) Assignee: Komag Incorporated, San Jose, CA (US)

( * ) Notice: Subject to any disclaimer, the term of this patent is extended or adjusted under 35 U.S.C. 154(b) by 0 days.

(21) Appl. No.: 09/421,451

(22) Filed: Oct. 19, 1999

(51) Int. Cl.[7] ..... B24B 7/17
(52) U.S. Cl. ..... 451/63; 451/168; 451/173
(58) Field of Search ..... 451/63, 173, 168, 451/302, 307; 29/90.01

(56) References Cited

U.S. PATENT DOCUMENTS

| | | | | |
|---|---|---|---|---|
| 4,262,452 | * | 4/1981 | Lopez | 451/63 |
| 4,347,689 | | 9/1982 | Hammond | 51/281 |
| 4,535,567 | | 8/1985 | Seaborn | 51/140 |
| 4,656,790 | | 4/1987 | Mukai et al. | 51/141 |
| 5,012,618 | | 5/1991 | Price et al. | 51/140 |
| 5,018,311 | | 5/1991 | Malagrino, Jr. et al. | 51/140 |
| 5,431,592 | | 7/1995 | Nakata | 451/63 |
| 5,643,044 | | 7/1997 | Lund | 451/5 |
| 5,673,156 | | 9/1997 | Chen et al. | 360/97.01 |
| 5,683,291 | * | 11/1997 | Humpert et al. | 451/168 |
| 5,791,969 | | 8/1998 | Lund | 45/5 |
| 6,129,612 | * | 10/2000 | Reynen et al. | 451/53 |

FOREIGN PATENT DOCUMENTS

| | | | | |
|---|---|---|---|---|
| 4-30674 | | 3/1987 | (JP) | G11B/25/04 |
| 1140958 | * | 6/1989 | (JP) | 451/63 |

* cited by examiner

*Primary Examiner*—Robert A. Rose
(74) *Attorney, Agent, or Firm*—Skjerven Morrill MacPherson LLP; David E. Steuber; Michael J. Halbert

(57) ABSTRACT

A burnishing tape apparatus includes pads that press the burnishing tape against the surfaces of the disk to be burnished. The pads are mounted on pad holders that are biased to press the pads against both sides of the disk. Tape guides are used to apply tension to the burnishing pad when the pads are moved away from the disk. When the pads are away from the disk tape guides hold the burnishing tape away from the pads so that the burnishing tape may be indexed without damaging or dislodging the pads. As the pads are moved into contact with the disk, the tape guides release the tension on the burnishing tape while the centering guides ensure that the burnishing tape is centered on the pads. By releasing tension on the burnishing tape, the pads are permitted to press the approximate center of the burnishing tape against the surfaces of the disk without deforming in an uncontrolled manner.

31 Claims, 16 Drawing Sheets

BURNISHING TAPE HANDLING APPARATUS AND METHOD

FIELD OF THE INVENTION

The present invention relates to an apparatus and method for burnishing the surfaces of a disk, and more specifically burnishing the surfaces of a disk with burnishing tape and pads.

BACKGROUND

Magnetic memory disks, such as the type typically used in a computer hard drive, have a smooth surface over which the read/write head flies during operation. The trend has been to reduce the fly height of the read/write head over the surface of the disk to increase the data recording density on the disk. While it is desirable for a read/write head to fly as close as possible to the surface of the disk, it is important that the read/write head does not contact the disk or defects on the surface of the disk. A defect on the surface of the disk that physically contacts the read/write head may damage the read/write head, the disk, or both. Consequently, care must be taken during the disk processing and testing to assure that there are no defects on the surface of the disk that are greater than the fly height of the read/write head, which today is approximately 1 $\mu$" (microinch) or less.

Typical magnetic disks include an aluminum, glass, or silicon substrate that is plated with a NiP (nickel phosphate) layer and then textured, e.g., for the contact start stop zone. An underlayer of Cr (chromium) or NiP is sputtered on the plated NiP layer, a thin film of magnetic recording material, typically a Co (cobalt) alloy, is sputtered on the underlayer, followed by the deposition of a protective coating and a lubrication layer. The disk is then burnished to remove any asperities prior to testing the disk to assure the disk meets the required surface specifications. Presently, some magnetic disks are specified to have a roughness less than or equal to about 30 angstroms (3 nanometers).

In conventional methods of burnishing the surfaces of a disk, an abrasive burnishing tape is used. Prior art devices for burnishing a disk with an abrasive tape include the use of air knives and rollers and in some instances the combination of the two. A disadvantage with the use of air knives and rollers is that it is difficult to control the force used to press the burnishing tape against the disk and to ensure that an equal amount of force is applied to both sides of the disk. Without precise control of the force applied to both sides of the disk, one side of the disk may be burnished more than the other. Further, if one side of the disk has a much greater force applied to it than the other, the disk may be damaged. In addition, with air knives it is difficult to control the precise area of the burnishing tape that is pressed against the disk. It is also difficult to burnish with an adequate amount of force without scratching the surface of the disk. Further, rollers are difficult to keep flat against the surface of the disk.

SUMMARY

A burnishing head in accordance with an embodiment of the present invention includes burnishing pads that press a burnishing tape against the surfaces of a disk. The pads are mounted on pad holders that move to press the burnishing tape against the surfaces of the disk with the pads. The burnishing apparatus also includes tape guides that hold the burnishing tape away from the pads when the pads are not pressed against the surfaces of the disk. With the burnishing tape separated from the pads, the burnishing tape may be indexed without damaging or dislodging the pads from the pad holders. As the pad holders move the pads away from the disk, the tape guides apply tension to the burnishing tape used to keep the burnishing tape from contacting the pads. As the pad holders move the pads into contact with the disk, the tape guides release tension on the burnishing tape to prevent uncontrolled deformation of the pads. Consequently, the entire footprint of each pad is used to press the burnishing tape into contact with the surfaces of the disk.

The burnishing apparatus operates by mounting a disk on a disk handling apparatus, such as a motor driven spindle. The disk is then moved between the pads of the burnishing apparatus. As the pads are moved to press the burnishing tape against the surfaces of the disk, the tape guides release tension on the burnishing tape. Because there is little or no tension on the burnishing tape during the burnishing process, the entire footprint of the pads press the burnishing tape against the surfaces of the disk.

Once the disk is burnished, the pad holders are separated, e.g., by way of a pneumatic actuator or a stepper motor. As the pads are moved away from the surface of the disk, tension is applied to the burnishing tape. The burnishing tape is held away from the pads as the burnishing tape is indexed. Additionally, the disk is removed from between the burnishing pads, and the disk is replaced with the next disk to be burnished. The next disk is then moved between the pads, which then are moved to press an unused portion of the burnishing tape into contact with the surfaces of the next dish.

In accordance with another embodiment of the present invention, the pads are mounted on pad holders that are coupled together with a tension spring. The tension spring biases the pad holders together such that the pads automatically press against the surfaces of the disk with an equal amount of force. The pad holders are slidably mounted on a rail which permits the pad holders to slide away from and toward each other. The pad holders have the freedom to slide in unison so that when the pads are pressed against the surfaces of the disk, the pads automatically align with the center of the disk. A separating mechanism, such as a pneumatic actuator, is used to overcome the bias of the spring and to move the pads away from the disk, for example, when the disk is being replaced and the burnishing tape is indexed.

BRIEF DESCRIPTION OF THE DRAWINGS

The above and other features, aspects, and advantages of the present invention will become better understood with regard to the following description, appended claims, and accompanying figures, where:

DETAILED DESCRIPTION

Figure 1:
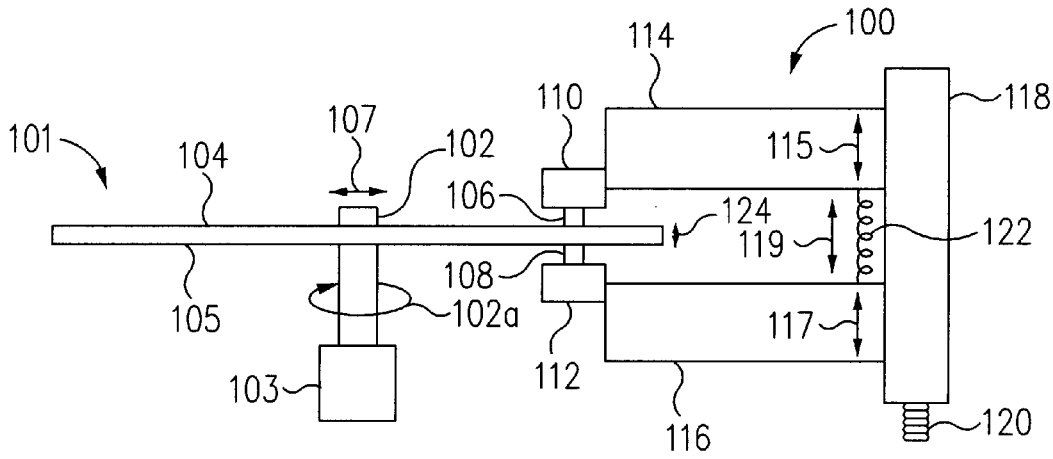
FIG. 1 is a top view of a disk being burnished by a burnishing apparatus in accordance with an embodiment of the present invention.

FIG. 1 is a top view of a magnetic disk 101 being burnished by a burnishing apparatus 100 in accordance with an embodiment of the present invention. The burnishing apparatus 100 uses burnishing pads 106 and 108 to press a burnishing tape (not shown in FIG. 1) against the surfaces of a magnetic disk 101 while magnetic disk 101 rotates about a spindle 102 as indicated by arrow 102*a*. As can be seen, burnishing pads 106 and 108 are static, non-rolling pads. Disk 101 is shown in a side view in FIG. 1. Burnishing apparatus 100 may be used to burnish not only magnetic disks, but any other disk, including, e.g., optical or magneto-optical disks.

Disk 101 is shown mounted on disk handling hardware including a spindle 102 that is driven by a motor 103 to rotate disk 101 at high speed, e.g., 500 inches per second (ips). The angular velocity, however, may range from 300 ips to 1000 ips, depending on the amount of burnishing desired and the length of processing time, i.e., the higher the angular velocity of disk 101, the shorter the processing time, but less burnishing will occur. In some embodiments, a constant linear velocity (CLV) may be used that vary from, e.g., 30 meters/minute to 300 meters/minute.

As disk 101 rotates, a burnishing surface of an abrasive burnishing tape is brought into contact with disk 101. Burnishing tape is pressed against both surfaces 104, 105 of disk 101 by pads 106 and 108, respectively, to burnish surfaces 104, 105. While disk 101 rotates about spindle 102, disk 101, spindle 102 and motor 103 are moved in a lateral direction, as illustrated by arrow 107, such that approximately the entire area of surfaces 104, 105 of disk 101, from the inside diameter to the outside diameter or vice versa, may be brought into contact with the burnishing tape and thereby burnished.

Once the burnishing of disk 101 is complete, disk 101, spindle 102 and motor 103 are moved away from burnishing apparatus 100, the rotation of disk 101 is stopped and disk 101 is removed from spindle 102. By moving disk 101 away from burnishing apparatus 100, disk 101 may be easily removed from spindle 102. A new disk to be burnished is then mounted on spindle 102. The rotation of the new disk is initiated and the new disk and spindle 102 are moved laterally between burnishing pads 106 and 108 to be burnished. It should be understood the lateral movement between disk 101 and burnishing apparatus 100 is relative. Thus, if desired, burnishing apparatus 100 may be moved laterally while disk 101, spindle 102 and motor 103 are held stationary as disk 101 rotates about spindle 102.

Pads 106, 108 are mounted on pad holders 110, 112, respectively, which are mounted on respective carriages 114, 116. Carriages 114, 116 are mounted on a rail 118. It should be understood that if desired pad holders 110, 112 may be mounted on rail 118 without intervening carriages 114, 116. Thus, carriages 114, 116 actually function as an extension of pad holders 110, 112 that is mounted on rail 118 and therefore may be considered part of pad holders 110, 112. Rail 118 is, e.g., a ball bearing linear slide rail or any other type of device that will permit carriages 114, 116 to move linearly back and forth perpendicular to the plane of disk 101 with little friction. A tension spring 122 connected between carriage 114 and carriage 116 is used to bias pads 106 and 108 together. Thus, as illustrated by arrows 115 and 117, respectively, carriages 114, 116 along with pad holders 110, 112 and pads 106, 108 move towards disk 101 to press pads 106, 108 against disk 101, i.e., in a "closed position," as shown in FIG. 1. Of course, during burnishing operations a burnishing tape is placed between burnishing pads 106 and 108 and sides 104 and 105, respectively. Rail 118 includes an inlet connector 120 for an air supply that is used to pneumatically separate carriages 114, 116. Thus, as illustrated by arrows 115 and 117, respectively, carriages 114, 116 along with pad holders 110, 112 and pads 106, 108 may be moved away from disk into an "open position." Of course, carriages 114, 116 need not be separated pneumatically, but may be separated by any desired manner to place pads 106, 108 into an open position.

With the use of tension spring 122 coupled to carriages 114, 116, pads 106 and 108 are biased together. Consequently, an equal amount of pressure is applied to surfaces 104, 105 of disk 101. By applying the same amount of pressure on surfaces 104 and 105 with pads 106 and 108, respectively, surfaces 104 and 105 will receive the same amount of burnishing. In addition, the equal application of pressure by pads 106, 108 results in no net force being applied to disk 101 thereby avoiding damage to disk 101.

Moreover, carriages 114, 116 are mounted on rail 118 such that carriages 114, 116 float, i.e., carriages 114, 116 move together in unison as illustrated by arrow 119. Because carriages 114, 116 move together in unison, pads 106, 108 will be centered on disk 101. Thus, carriages 114 and 116 are automatically aligned with disk 101, thereby avoiding damage to disk 101 when pads 106, 108 are placed in contact with disk 101. Carriages 114 and 116 have approximately 0.250" of float or movement that accommodates any noncentered condition of disk 101 and will thereby maintain equal pressure on surfaces 104 and 105. Thus, if disk 101 is not centered, carriages 114 and 116 will move together to place disk 101 in the center of pads 106 and 108.

Figure 2:
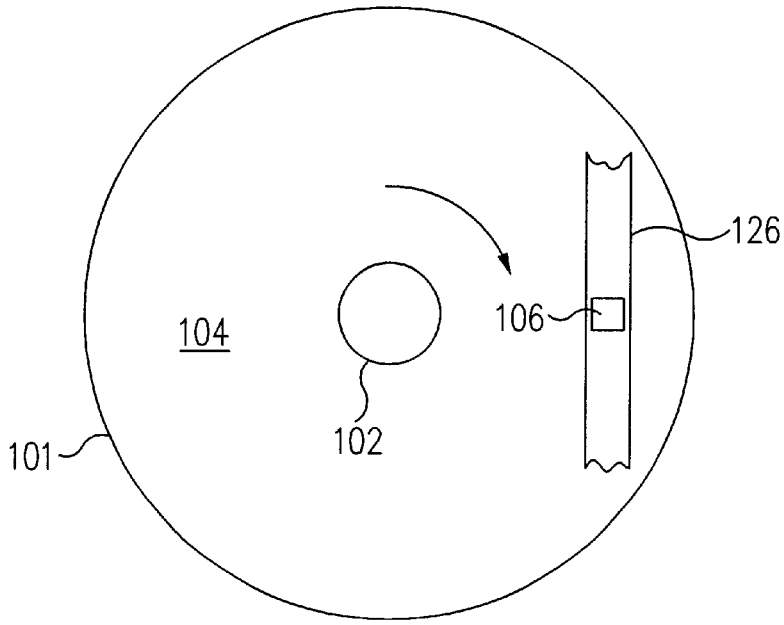
FIG. 2 shows a top plan view of the disk mounted on spindle with a pad pressing a portion of burnishing tape against the surface of the disk.

FIG. 2 shows a top plan view of disk 101 mounted on spindle 102 with pad 106 pressing a portion of burnishing tape 126 against surface 104. In accordance with one embodiment of the present invention, burnishing tape 126 extends tangentially over disk 101, as shown in FIG. 2. Thus, as pad 106 presses burnishing tape 126 against surface 104, the edges of burnishing tape 126 will not contact disk 101. Consequently, the edges of burnishing tape 126 will not scratch or otherwise damage disk 101. In addition, burnishing tape 126 has enough surface tension that when pad 106 presses tape 126 against surface 104, the only portion of tape 126 that contacts surface 104 is below the footprint of pad 106. By ensuring that only the portion of burnishing tape 126 that is below the footprint of pad 106 is in contact with surface 104, the amount of burnishing by tape 126 may be precisely controlled, e.g., by changing the pad size. It should be understood that another burnishing tape is similarly pressed into contact with surface 105 by pad 108, but is hidden from view in FIG. 2.

Burnishing tape 126 may be any tape with an appropriate roughness to burnish disk 101. One example of burnishing tape 126 is 1 micron Alumina manufactured by Mypox of Japan.

Pads 106, 108 may be any soft material, such as neoprene rubber, that is deformable during use and preferably has anti-static properties. Pads 106, 108 are approximately 5 mm×12 mm or 5 mm×10 mm, with a thickness of 2.5 mm. An example of a material that may be used as pads 106, 108 is the neoprene rubber material model number 4701-40, formerly manufactured by Rubitex of Texas.

Figure 3:
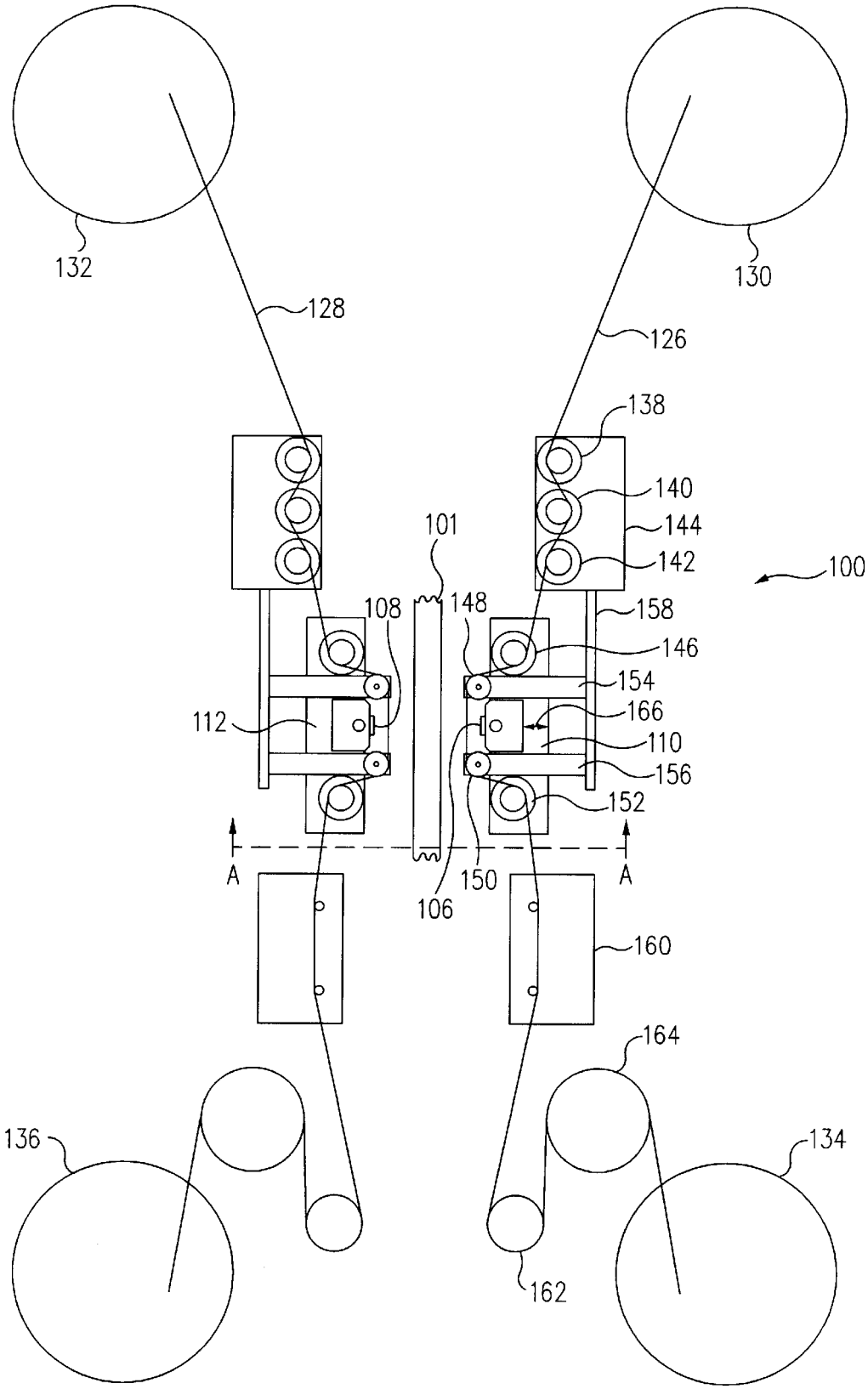
FIG. 3 shows a side view of the burnishing apparatus with pads, mounted on pad holders, positioned such that the pads are not in contact with the disk.
Figure 4:
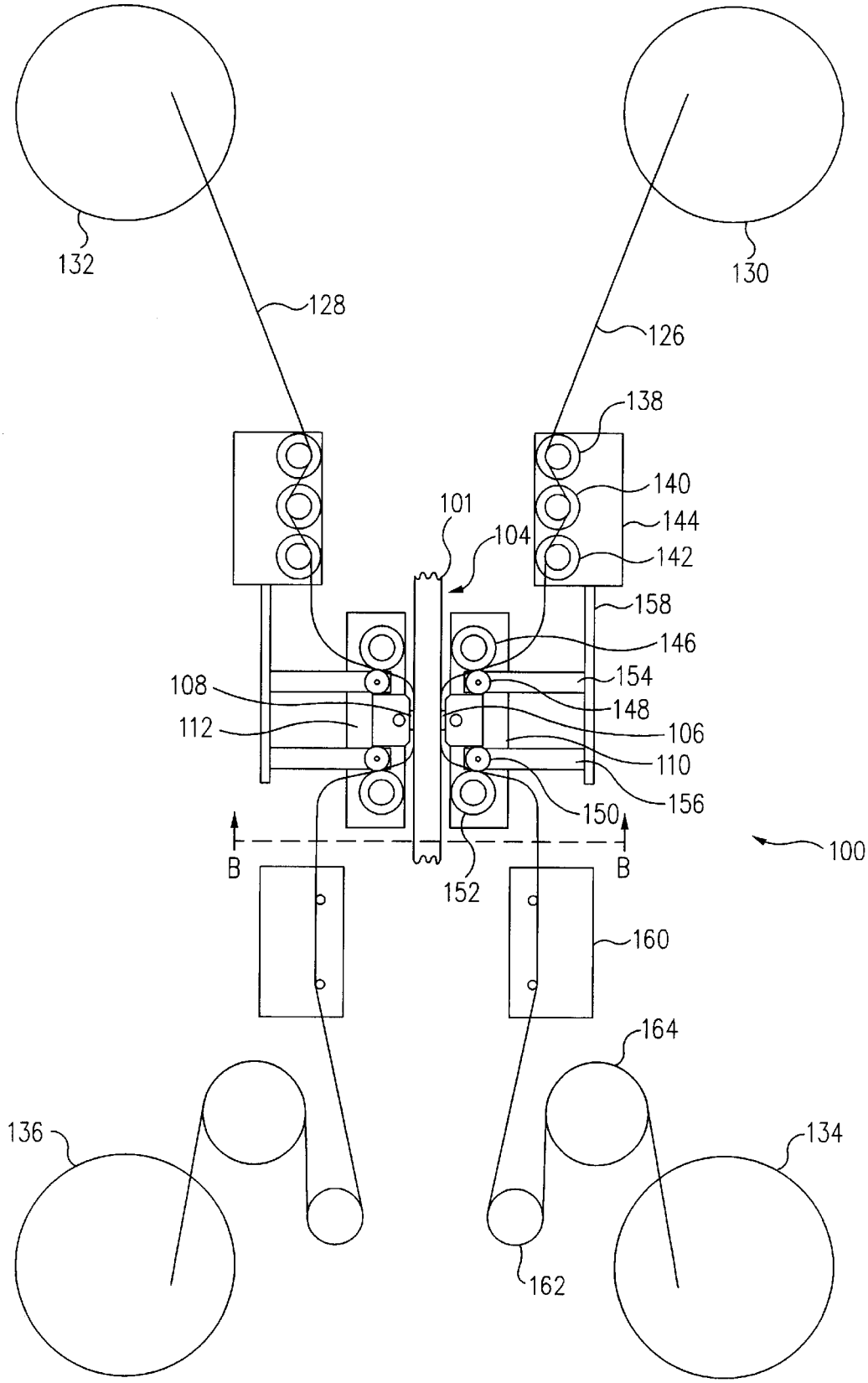
FIG. 4 shows a side view of the burnishing apparatus with pads, mounted on pad holders, positioned such that the pads are in contact with the disk.

FIGS. 3 and 4 show front views of burnishing apparatus 100 with pads 106, 108 in the "open position" (i.e., not in contact with disk 101) and in the "closed position" (i.e., pressing against disk 101), respectively. As shown in FIGS. 3 and 4, burnishing apparatus 100 also includes tape handling hardware, which generates the desired tension in the burnishing tape while pads 106, 108 are in the open and closed positions. FIGS. 3 and 4 do not show carriages 114, 116, tension spring 122, or rail 118 for the sake of clarity.

FIG. 3 shows pads 106 and 108, mounted on respective pad holders 110 and 112, in the open position. Burnishing tapes 126 and 128 extend from respective supply reels 130, 132 to respective take-up reels 134, 136. For the sake of clarity and simplicity, the path of burnishing tape 126 will be described with the understanding that the path of burnishing tape 128 is the same but in mirror image.

Burnishing tape 126 extends over rollers 138, 140, and 142, which are mounted on an upper tape tracking assembly 144. Burnishing tape 126 extends around a first tape guide roller 146, over two centering guides 148 and 150 and around a second tape guide roller 152. Tape guide rollers 146, 152 are mounted on pad holder 110, while centering guides 148, 150 are mounted on arms 154, 156, respectively, which are connected to upper tape tracking assembly 144 via an intermediate arm 158. Burnishing tape 126 then continues through a tape guide 160, around a capstan assembly with rollers 162 and 164 and is received by take-up reel 134.

The upper tape tracking assembly 144 and centering guides 148, 150, along with the various associated arms, are held in a fixed position. Pad holder 110 with pad 106, however, is not fixed, and may move laterally as illustrated by arrow 166 so that pad 106 may be placed into a closed position, as shown in FIG. 4, or an open position as shown in FIG. 3.

FIG. 4 shows burnishing apparatus with pads 106 and 108 in a closed position pressing against disk 101. As can be seen in FIG. 4, pad holder 110 has moved toward disk 101 relative to centering guides 148, 150.

Figure 5:
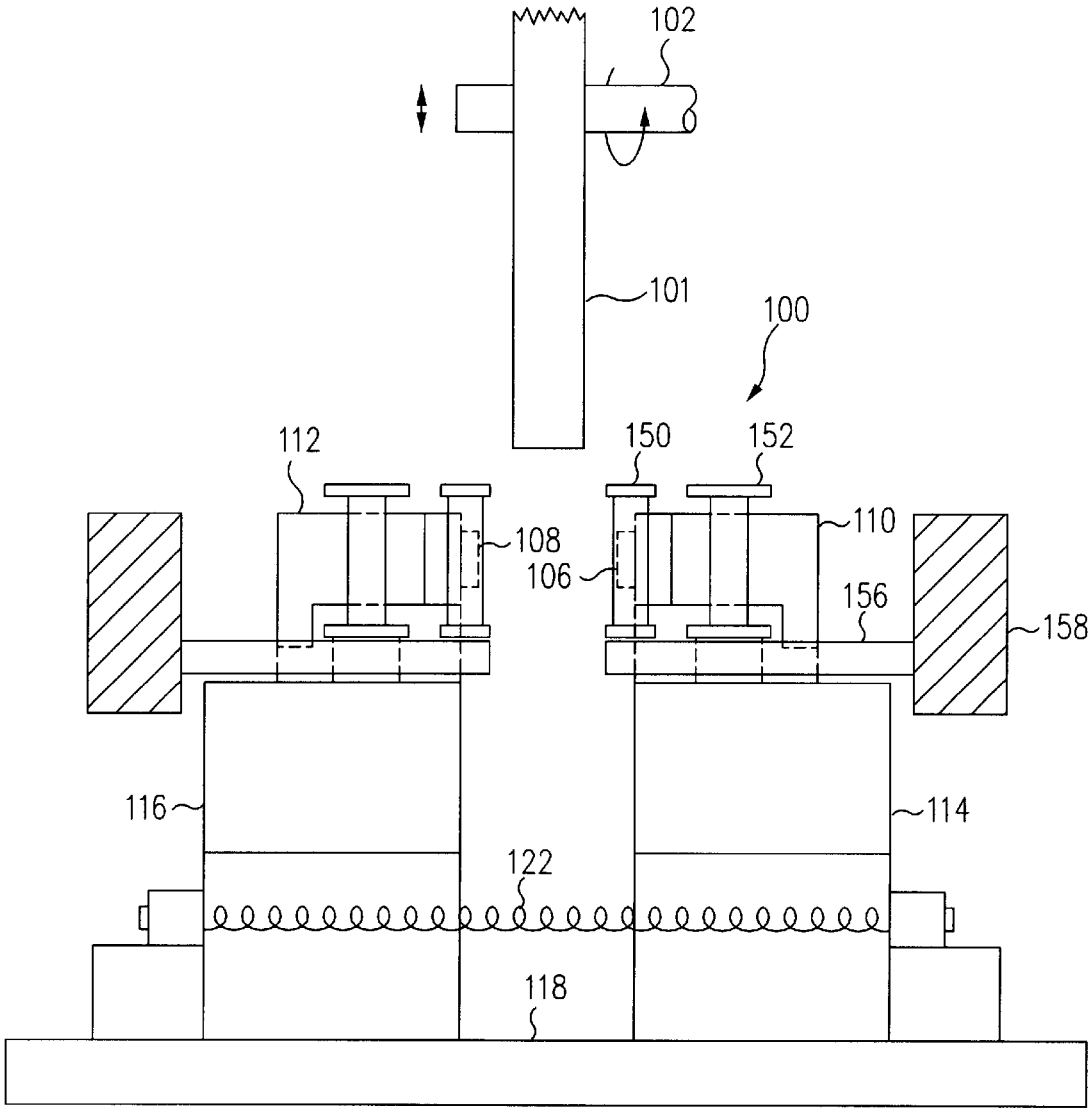
FIG. 5 is a simplified top view of the burnishing apparatus along dimensions A—A illustrated in FIG. 3.
Figure 6:
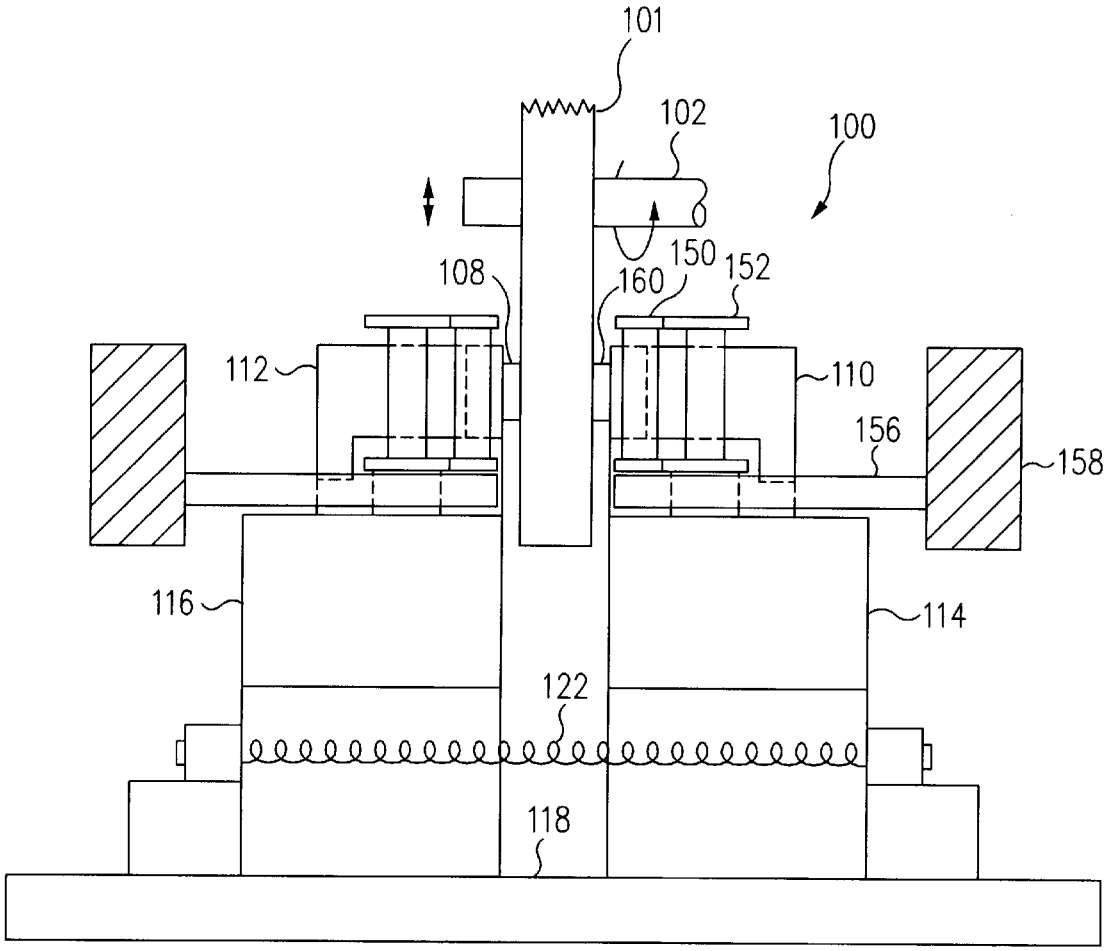
FIG. 6 is a simplified top view of the burnishing apparatus along dimensions B—B illustrated in FIG. 4.

FIG. 5 is a simplified top view of burnishing apparatus 100 in an open position shown along dimensions A—A as illustrated in FIG. 3. FIG. 6 is a simplified top view of burnishing apparatus 100 in a closed position shown along dimensions B—B as illustrated in FIG. 4. FIGS. 5 and 6 show pad holder 110, 112 mounted on carriages 114, 116, which are mounted on rail 118. Also shown in FIGS. 5 and 6 is the spring 122 biasing pad holders 110 and 112 together. Burnishing tapes 126 and 128 and part of the tape handling hardware, i.e., supply reel 130, upper tape tracking assembly 144, tape guide 160, rollers 162, 164 and take-up reel 134, are not shown in FIGS. 5 and 6 for the sake of clarity.

As illustrated in FIGS. 3 and 5, when pad holder 110 is in an open position, pad 106 does not contact burnishing tape 126. As discussed above, pad holder 110 is pneumatically forced into an open position. When placed in an open position, pad holder 110 is moved away from disk 101 by an amount sufficient to ensure that pad 106 does not contact burnishing tape 126 and to cause tape guide rollers 146, 152 to press against tape 126 applying tension to tape 126. Pad holder 110 may move approximately 0.250" to 0.375" when transitioning from a closed position (with pads 106 and 108 in contact with disk 101) to an open position. When in an open position, pad 106 is approximately 1 mm away from burnishing tape 126. Centering guides 148, 150, which are held stationary relative to pad holder 110, hold burnishing tape 126 away from pad 106. With pad holder 110 in the open position, disk 101 is moved from between pads 106 and 108. Disk 101 may then be removed and replaced with another disk to be burnished. Meanwhile, tape 126 is indexed so that an unused portion of burnishing tape 126 is placed in front of pad 106. Because centering guides 148, 150 hold burnishing tape 126 away from pad 106 while tape 126 is indexed, burnishing tape 126 may be advanced without damaging or dislodging pad 106. Consequently, the life of pad 106 is increased. When pad holder 110 is placed in a closed position (as shown in FIGS. 4 and 6) an unused portion of burnishing tape 126 will be between pad 106 and disk 101.

A motor (not shown) connected to take-up reel 134 rotates take-up reel 134 by the appropriate amount to index the burnishing tape 126. In addition, the capstan assembly, shown as rollers 162 and 164 in FIG. 3, may be driven by a motor to index the burnishing tape. A spring on the supply reel 130 provides the appropriate amount of resistance in the rotation of supply reel 130 to maintain tension on tape 126 as the motor driven take-up reel 134 indexes tape 126. Supply reel 130 is discussed in more detail in reference to FIG. 10.

Pad holder 110 is placed in a closed position by decreasing the pneumatic force below the bias force of tension spring 122 (shown in FIGS. 5 and 6). Thus, pad holder 110 along with tape guide rollers 146, 152 moves toward disk 101 into the closed position (shown in FIG. 4 and 6). Because tape guide rollers 146, 152 move toward disk 101 when in the closed position, tension that was applied by tape guide rollers 146, 152 when in the open position is relieved. There is little or no tension applied to burnishing tape 126 when the burnishing pads are pressed against the disk, as illustrated in FIG. 4. Consequently, when pad 106 presses burnishing tape 126 against surface 104 of disk 101, pad 106 will not be deformed from tension on burnishing tape 126. Thus, burnishing tape 126 is pressed against disk 101 by the entire surface area of pad 106. If there is tension on burnishing tape 126 as pad 106 presses against disk 101, the corners and sides of pad 106 would be deformed by tape 126 causing only a central portion of the surface area of pad 106 to press tape 126 against disk 101. This would cause a loss of efficiency in the burnishing of disk 101, as well as less control over the equalization of burnishing on both sides of disk 101.

In addition, as pad holder 110 moves forward toward disk 101, centering guides 148, 150 center burnishing tape 126 with respect to pad 106. The flanges on centering guides 148, 150 and the flanges on tape guide rollers 146, 152 hold tape 126 such that it is centered on pad 106 as pad holder 110 moves into the closed position. Thus, when pad 106 makes contact with burnishing tape 126, pad 106 is centered on the tape 126.

Figure 7B:
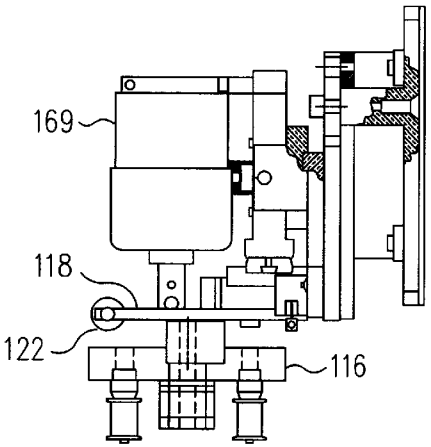
FIGS. 7A, 7B, 7C are detailed top, side and front views, respectively, of burnishing apparatus.
Figure 7A:
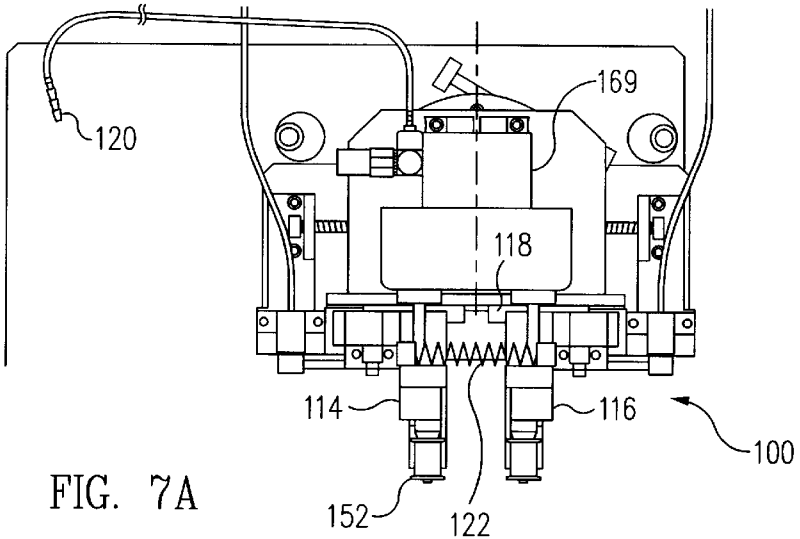
Figure 7C:
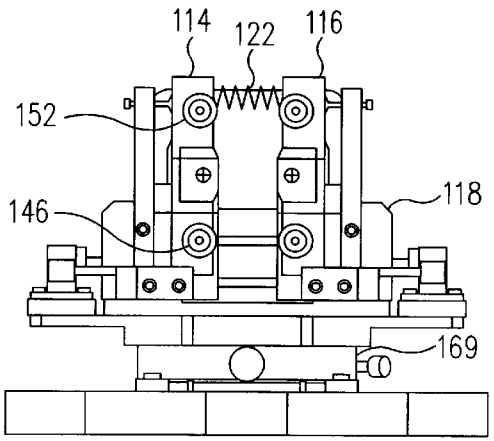

FIGS. 7A, 7B, 7C are detailed top, side and front views, respectively of burnishing apparatus 100 without burnishing tape 126, 128, arms 154, 156 or centering guides 148, 150. As shown in FIGS. 7A, 7B, and 7C, rail 118 is connected to a pneumatic apparatus 169 for opening pad holders 110, 112. of course any other means for opening pad holders 110, 112 may be used. Pneumatic apparatus 169 is a conventional pneumatic rotary cylinder, such as Model P/N manufactured by Shunck Corporation.

Figure 8:
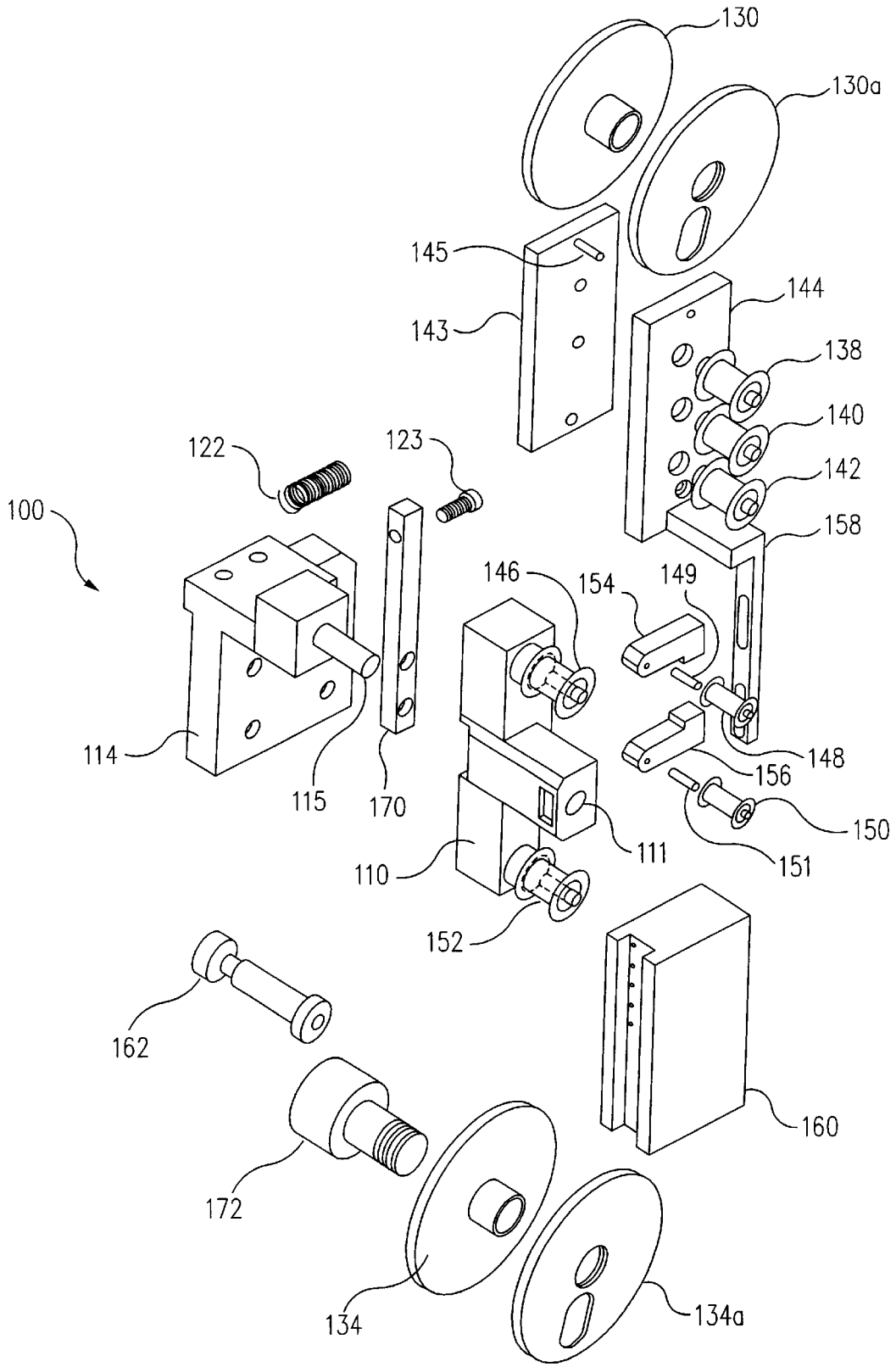
FIG. 8 shows an exploded perspective view of the burnishing apparatus.

FIG. 8 shows an exploded perspective view of burnishing apparatus 100 where only one side of burnishing apparatus 100 is illustrated for the sake of clarity. FIG. 8 also shows the tape handling mechanism.

As shown in FIG. 8, burnishing apparatus 100 includes pad holder 110 upon which are mounted tape guide rollers 146 and 152. Pad holder 110 includes a depression 113 in which pad 106 is mounted. Pad 106 may be mounted using a rubber based glue such as BHE Adhesive or High Strength 90 Adhesive manufactured by 3M. Of course, pad 110 may use any mounting surface and does not necessarily require a depression. Pad 106 is not shown mounted on pad holder 110 in FIG. 7 for the sake of clarity. Pad holder 110 is mounted on carriage 114 with pin 115 passing through a central orifice 111 in pad holder 110. It should be understood that if desired, carriage 114 and pad holder 110 may be one unit. Thus, one unit may serve as both pad holder 110 and carriage 114. A bolt (not shown) may be used to tighten pad holder 110 on pin 115. Also mounted on carriage 114 is a spring tension arm 170 upon which is mounted tension spring 122 via bolt 123. Tension spring 122 is also mounted on the complementary spring tension arm on the other pad holder 110. Tension spring 122 is, e.g., part number 185-A spring manufactured by Century of Los Angeles, Calif. When in the closed position, spring 122 provides a force of approximately 100 grams.

Centering guides 148, 150 are mounted onto arms 154, 156 via pins 149, 151, respectively. Pins 149, 151 may serve as axes about which centering guides 148, 150 rotate or, alternatively, may simply hold centering guides 148, 150 which do not rotate. Centering guides 148, 150 may be manufactured from Teflon or other similar material. Arms 154, 156 are mounted on an intermediate arm 158. Arms 154, 156 may of course be mounted on any element that is stationary relative to the movement of pad holder 110, such as a wall.

Figure 9A:
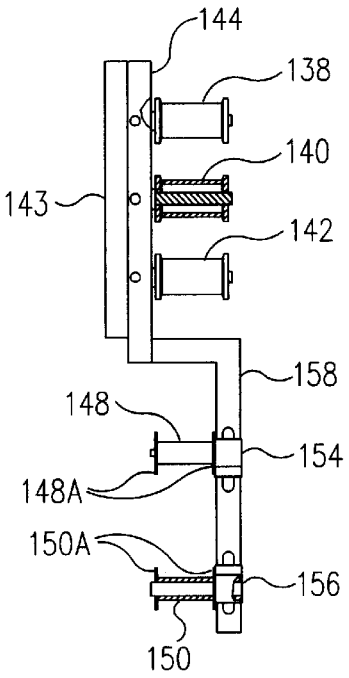
FIGS. 9A and 9B show respective side and top views of an upper tape tracking assembly with an intermediate arm upon which are mounted centering guides.
Figure 9B:
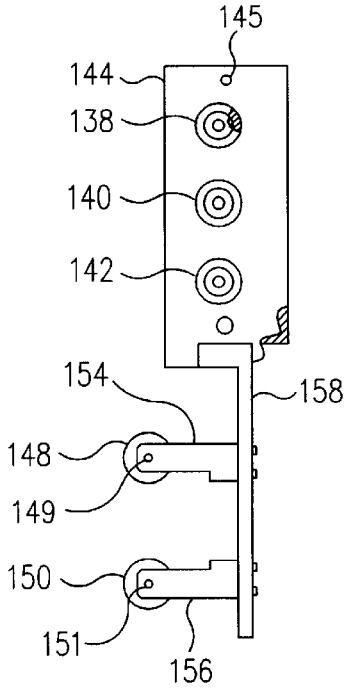

Intermediate arm 158 is mounted to upper tape tracking assembly 144, which is mounted on back plate 143 with guide pin 145. FIGS. 9A and 9B show respective side and top views of upper tape tracking assembly along with intermediate arm 158 and centering guides 148, 150. As shown in FIG. 9A, centering guides 148 and 150 include flanges 148A and 150A, respectively to ensure that the burnishing tape 126 is maintained centered on pad 106.

The upper tape tracking assembly 144 and centering guides 148, 150 along with the arms 154, 156, and 158 are held in a fixed position, while carriage 114 with pad holder 110 is permitted to slide on rail 118 (not shown in FIG. 8).

Take-up reel 134 with cover 134*a* is driven by motor 172. Supply reel 130 with cover 130*a* is spring loaded to provide a desired amount of resistance when indexing the burnishing tape 126.

Figure 10:
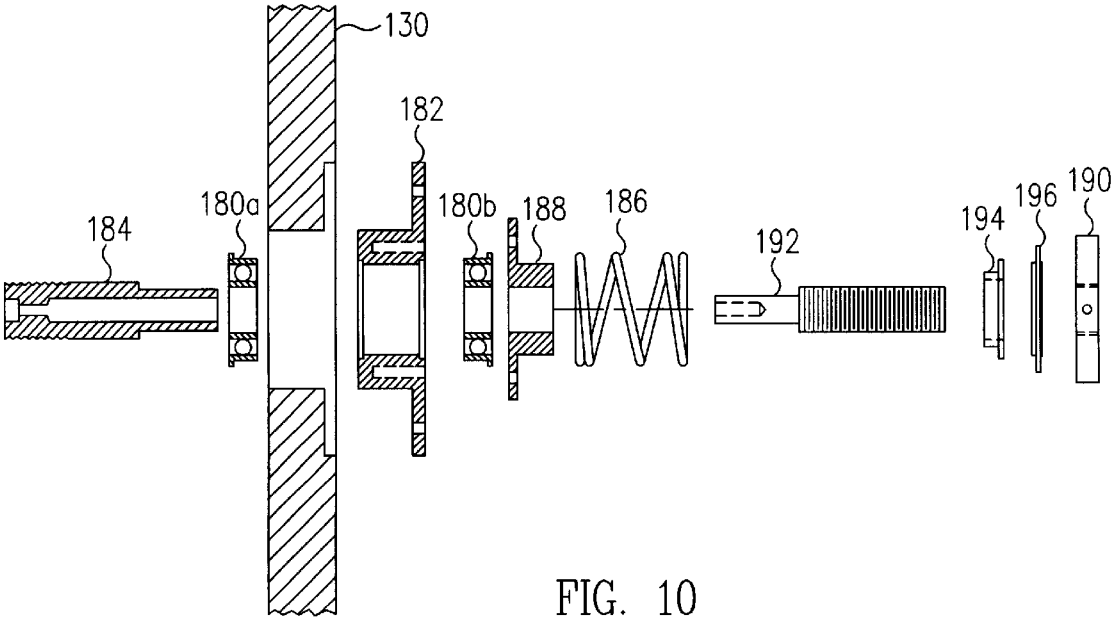
FIG. 10 shows a cut-away side view of a supply reel with a spring loaded mechanism to adjust the resistance of the rotation of supply reel.

FIG. 10 shows a cut-away side view of supply reel 130 with a spring loaded mechanism to provide resistance to the rotation of supply reel 130. Supply reel 130 is mounted on bearings 180*a*, 180*b*, and 182, which are mounted on axis 184. A spring 186 is pressed against supply reel 130 via a washer 188. A nut 190 may be tightened on a bolt 192, which is coupled to axis 184 to adjust the force with which spring 186 is pressed against supply reel 130. Washers 194 and 196 are used to center spring 186 on nut 190. Thus, by adjusting nut 190 the resistance in the rotation of supply reel 130 may be adjusted to the desired amount, e.g., 100 grams.

The force applied by tension spring 122 may be adjusted by adjusting the distance between the tension arms on the pad holders 110 and 112. Further, the tension on the burnishing tape 126 may be adjusted by altering the position of tape guides 146 and 152 relative to the position of the pads 106 and 108. By moving tape guides 146 and 152 away from disk 101, tension on burnishing tape 126 will be increased, while moving tape guides 146 and 152 towards disk 101 will decrease the tension on burnishing tape 126.

The force applied by tension spring 122 and the tension on burnishing tape 126 is calibrated by burnishing a test disk. Ink, e.g., from a felt tip marker, or some similar substance is applied to the test disk prior to burnishing the test disk. The ink is transferred to the burnishing tape during the burnishing process. Thus, by inspection of the burnishing tape after burnishing the marked test disk, one can determined whether the pad is square to the surface of the disk. A square pad print on the burnishing tape indicates that the pad is square to the disk.

Figure 11:
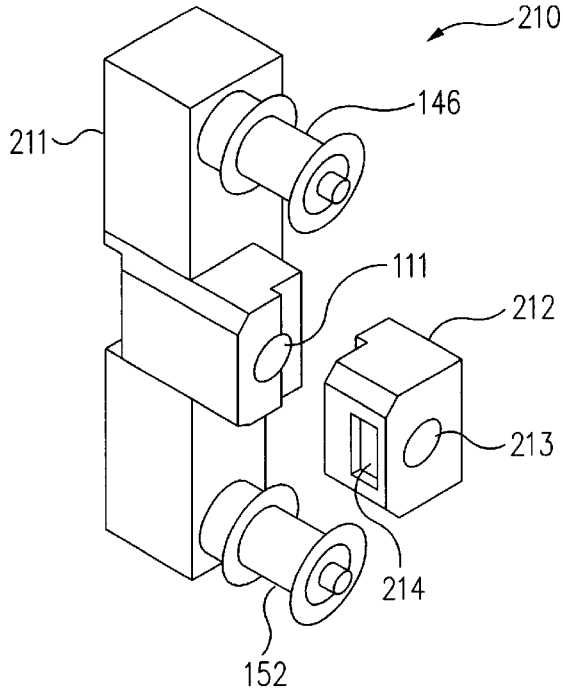
FIG. 11 shows a perspective view of a pad holder with a removable tip.

FIG. 11 shows a perspective view of a pad holder 210 in accordance with another embodiment of the present invention. Pad holder 210 is similar to pad holder 110 (FIG. 8) like designated elements being the same, however, pad holder 210 includes a main body 211 on which is mounted a removable tip 212. Tip 212 includes a depression 214 in which pad 106 is mounted. Tip 212 also includes a central orifice 213 that is aligned with orifice 111 when tip 212 is mounted on pad holder 210.

Tip 212 is mounted on body 211 of pad holder 210 with a bolt 215. The use of a removable tip 212 permits pad 106 to be replaced with a new pad without requiring the disassembly of burnishing apparatus 100. Advantageously, with the use of tip 212, pad 106 can be replaced by simply removing tip 212. A new pad may then be mounted on tip 212, which is then remounted on body 211 or a new tip, upon which a new pad is mounted, may then be mounted on body 211 of pad holder 210.

Figure 12A:
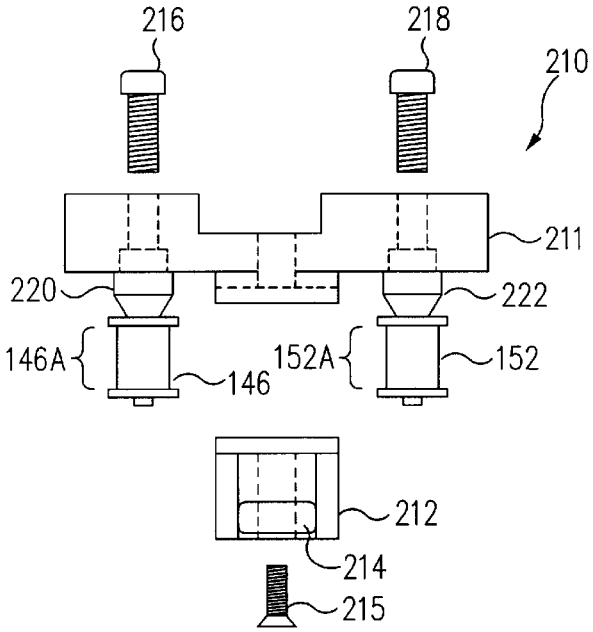
FIGS. 12A and 12B show side and top views, respectively, of the pad holder shown in FIG. 11.
Figure 12B:
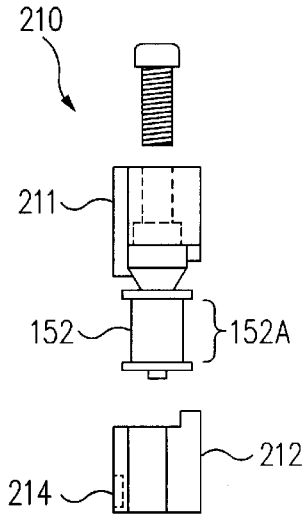

FIGS. 12A and 12B show side and top views, respectively of pad holder 210. As shown in FIGS. 12A and 12B, tape guide rollers 146 and 152 include flanges 146A and 152A, which assist in maintaining the correct position of burnishing tape 126 (shown in FIGS. 3 and 4). Tape guide rollers 146 and 152 are mounted on the body 211 of pad holder 210 via bolts 216 and 218, respectively, along with respective spacers 220 and 222. Spacers 220 and 222 ensure that tape guide rollers 146 and 152 are at the correct position relative to pad 106 (shown in FIGS. 3 and 4) as well as permitting rotation of tape guide rollers 146 and 152. It should be understood that tape guide rollers 146 and 152 may be mounted on pad holder 110 (shown in FIGS. 3 and 4) in a similar manner.

Figure 13:
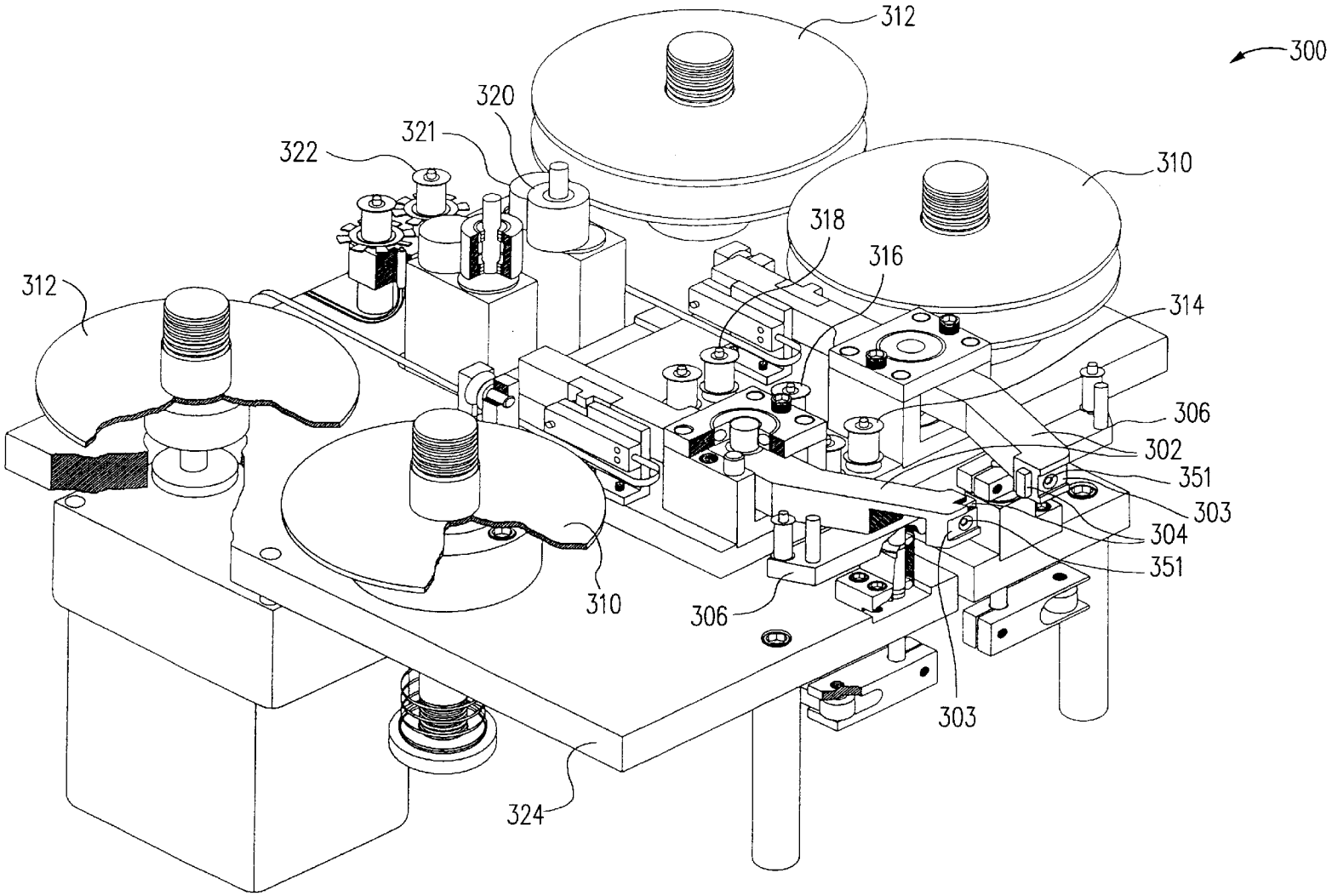
FIG. 13 is a perspective view of a burnishing apparatus in accordance with another embodiment of the present invention with the pads mounted on scissor-like pad holders.

FIG. 13 is a perspective view of a burnishing apparatus 300 in accordance with another embodiment of the present invention. The pad holders on burnishing apparatus 300 are opposing scissor-like pad arms 302, on which are mounted burnishing pads 304. Burnishing apparatus 300 also includes swing arms 306, which provide tension on burnishing tape (not shown for the sake of clarity) when the tape is to be indexed. Burnishing apparatus 300 also includes supply reels 310 and take-up reels 312, which are similar to the supply reels and take-up reels described above. A series of rollers 314, 316, 318, capstan rollers 320, 321 and index guides 322 are also included in burnishing apparatus 300. A base plate 324 is also provided, which advantageously separates motors (e.g., used with the take-up reels 312) and moving parts from the burnishing area near burnishing pads 302.

Burnishing apparatus 300 operates in a manner similar to burnishing apparatus 100 described above. Burnishing apparatus 300, however, does not use pad holders that move on a linear slide rail, such as the type manufactured by Del-Tron part number 101x, but uses scissor-like pad arms 302 as pad holders that have a rotational movement.

Figure 14:
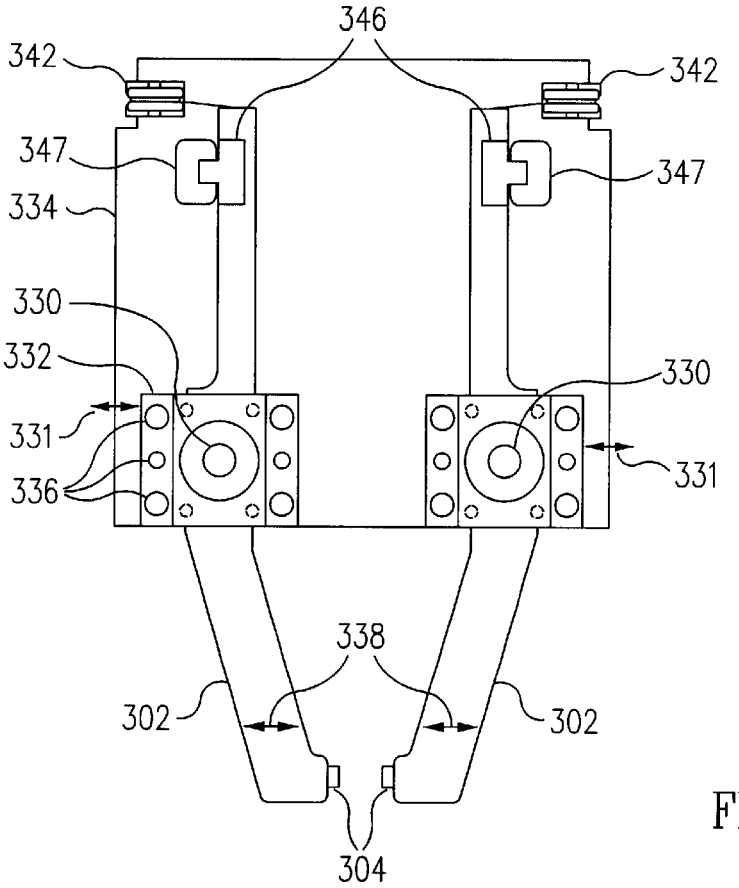
FIGS. 14 and 15 are respective top plan and front views of opposing pad holders used in the burnishing apparatus shown in FIG. 13.
Figure 15:
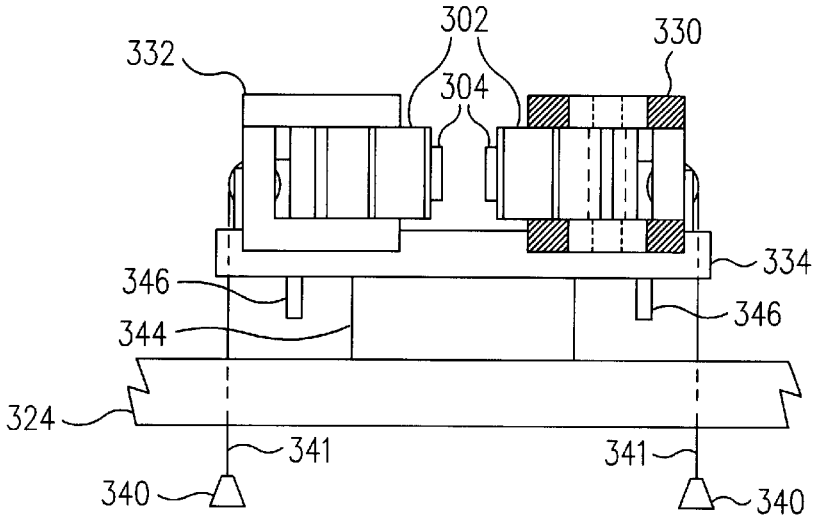

FIGS. 14 and 15 are respective top plan and front views of opposing pad arms 302. Pad arms 302 are mounted on bearings 330 at approximately the center of mass. Pad arms 302 are preferably balanced at the point of rotation at bearings 330. Bearings 330 include a housing 332 that is attached to a pad arm plate 334 by pins and/or bolts 336 or any other appropriate method. Thus, pad arms 302 swing open and closed, i.e., respectively away and towards each other, as indicated by arrows 338.

Dead weights 340, shown in FIG. 15, are coupled to one end of pad arms 302 via dead weight rollers 342, which are mounted on pad arm plate 334. Pad arm plate 334 is mounted above base plate 324 by a support 344. Dead weights 340 hang by a cable 341 below base plate 324, as shown in FIG. 15. Dead weights 340 bias pad arms 302 into a closed position, i.e., pads 304 are biased together. Because pad arms 302 are balanced at the point of rotation at bearings 330, the force with which pads 304 are biased together can be carefully controlled. Thus, for example, a fifty gram dead weight 340 (including the weight of cable 341) will supply a 50 gram bias force on pads 304. When pad arms 302 are in a closed position, pads 304 press a burnishing tape against the surfaces of a disk.

Pad arms 302 also include extensions 346, which extend below pad arm plate 334 through holes 347. Extensions 346 are used to open pad arms 302 and to permit pad arms 302 to close in a controlled fashion as will be described in more detail below in reference to FIG. 17. Extensions 346 may be integrally formed as part of arms 302 or may be a separate element that is mounted on arms 302.

In one embodiment of the present invention, housing 332 may be adjusted inward and outward as indicated by arrows 331, for example by adjustment screws. Thus, distance between pad arms 302 may be adjusted to compensate for variations in the thickness of the disk being burnished, e.g., when different types of disks are being burnished. Further, if the size or shape of the burnishing pad 304 varies, the distance between pad arms 302 may be adjusted accordingly. In another embodiment, both housings 332 may be placed on a linear slide and coupled together with a spring that provides less force than dead weights 340. Thus, arms 302 and pads 304 will be automatically biased together to provide equal pressure on both sides of a disk and will be automatically centered on the disk.

Figure 16:
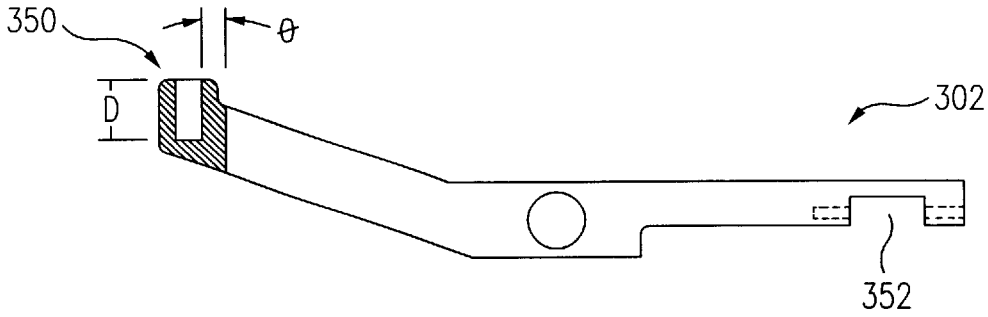
FIG. 16 shows a top plan view of one pad holder.

FIG. 16 shows a top plan view of one pad arm 302. Pad arm 302 includes a notch 350 at one end of the arm 302 into which a burnishing pad 304 is mounted. Notch 350 is approximately 0.3 inches deep. Burnishing pad 304 is mounted to pad arm 302 by inserting burnishing pad 304 into notch 350 and inserting a pin 351 (shown in FIG. 13) through the pad arm 302 and into burnishing pad 304. Thus, burnishing pad 304 may be easily replaced. Of course, if desired, burnishing pad 304 may be glued or otherwise mounted to pad arm 302. Notch 350 is at a small angle $\theta$, e.g., approximately two degrees, relative to perpendicular to pad arm 302. Consequently burnishing pad 304 is held at a small angle relative to perpendicular. Thus, when pad arm 302 is closed, the entire top surface of burnishing pad 304 is pressed against the surface of a disk. A second notch 352 is located at the other end of pad arm 302 and is used to mount extension 346.

Pads 304 may be for example 0.46×0.4 inches and 3/16 inch thick. Pads 304 may be manufactured from a material such as Poron 4701-40 from Western Rubber and Supply, located in Livermore, Calif.

Figure 17:
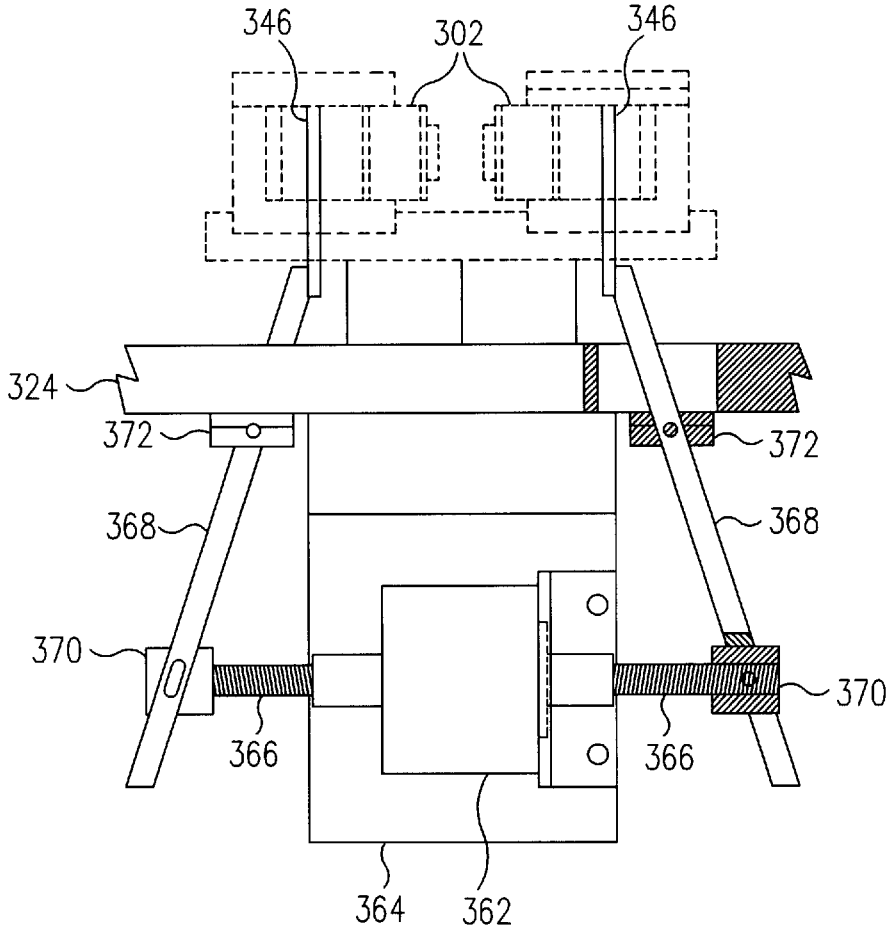
FIG. 17 shows the apparatus used to open and close the pad holders.

FIG. 17 shows a stepper motor 362 used to open and close pad arms 302. FIG. 17 also shows a front view of pad arms 302 (similar to that shown in FIG. 15) in broken lines and extensions 346. Stepper motor 362, which for example is manufactured by IMS, is mounted under base plate 324 on a mount plate 364. Stepper motor 362 drives a pair of screws 364 that are coupled to actuator arms 368 with nuts 370. Actuator arms 368 are mounted to base plate 324 at hinges 372.

As shown in FIG. 17, the ends of actuator arms 368 contact extensions 346. Thus, to open pad arms 302, stepper motor 362 rotates screws 366 to force nuts 370 away from each other. Consequently, actuator arms 368 press inward on extensions 346. As extensions 346 are pressed toward each other, burnishing pads 304 at the end of pad arms 302 will be opened, i.e., moved away from each other. By reversing stepper motor 362, pad arms 302 may be closed. Because a stepper motor 362 is used, pad arms 302 are closed in a controlled fashion. Thus, the initial contact between the disk and the burnishing tape is gentle, which advantageously prevents damage to the disk.

Figure 18:
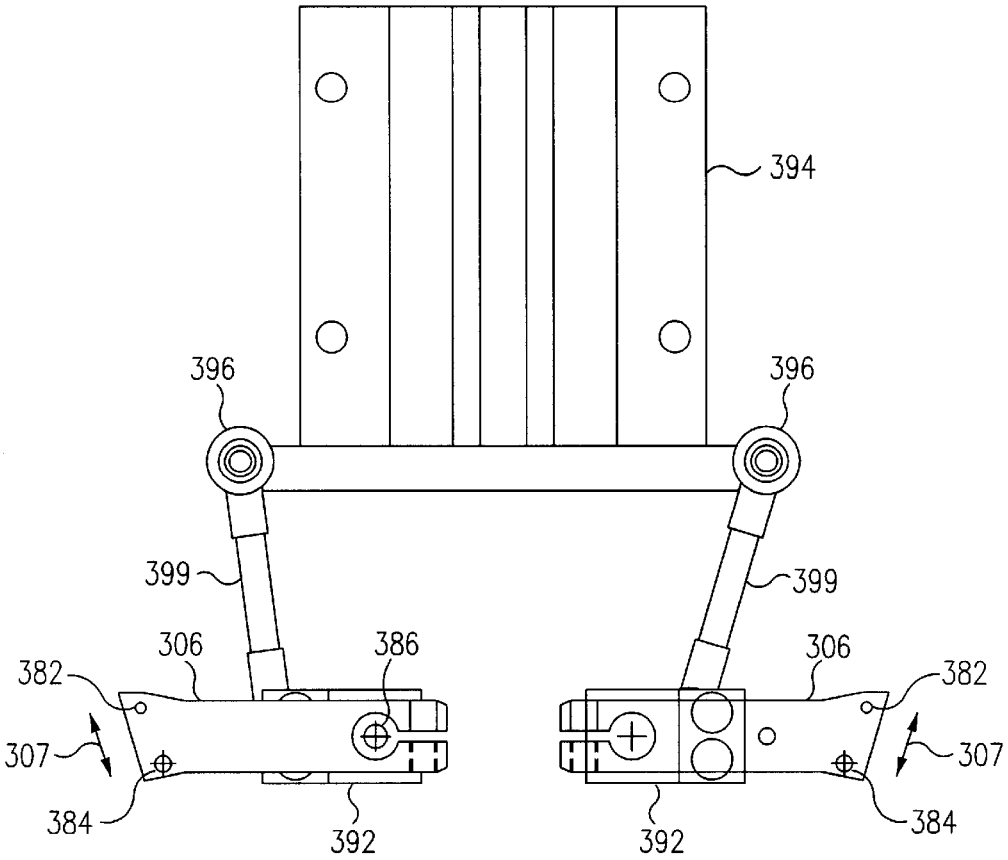
FIGS. 18 and 19 show a top plan view and a front end view, respectively, of the swing arms used to release and provide tension on the burnishing tape.
Figure 19:
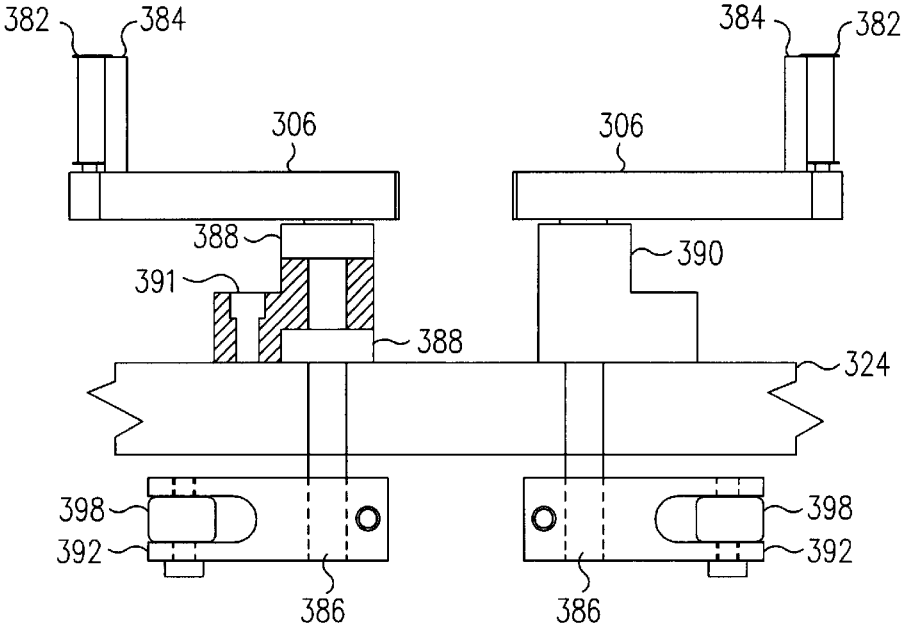

FIGS. 18 and 19 show a top plan view and a front end view, respectively, of swing arms 306 and the apparatus that rotates swing arms 306 to release and provide tension on the burnishing tape.

Tape guides 382 and 384 are mounted on swing arms 306. Because the abrasive side of the burnishing tape will contact tape guide 382, tape guide 382 is a roller. Tape guide 384 only contacts the back side of the burnishing tape and therefore may be a pin. Swing arms 306 are mounted on a shaft 386 that extends through bearings 388 and bearing housing 390. Bearing housing 390 is mounted to base plate 324 by bolt 391. Shaft 386 extends through base plate 324 and is mounted to actuator arms 392. Actuator arms 392 are coupled to a linear actuator 394 via couplers 396, 398 and tie rods 399. Thus, as linear actuator 394 slides back and forth, actuator arms 392 will rotate shaft 386, which will rotate swing arms 306 as indicated by arrows 307.

Figure 20:
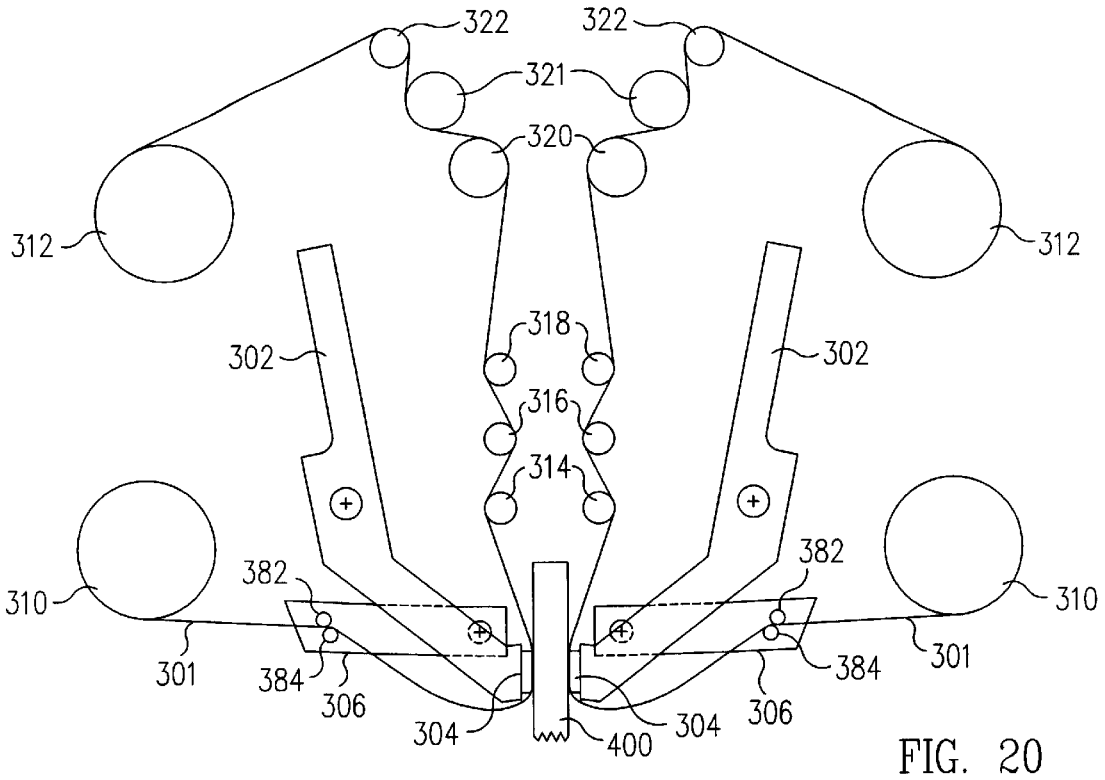
FIGS. 20 and 21 show a simplified top plan view of burnishing apparatus 300 in a closed and an open position, respectively.
Figure 21:
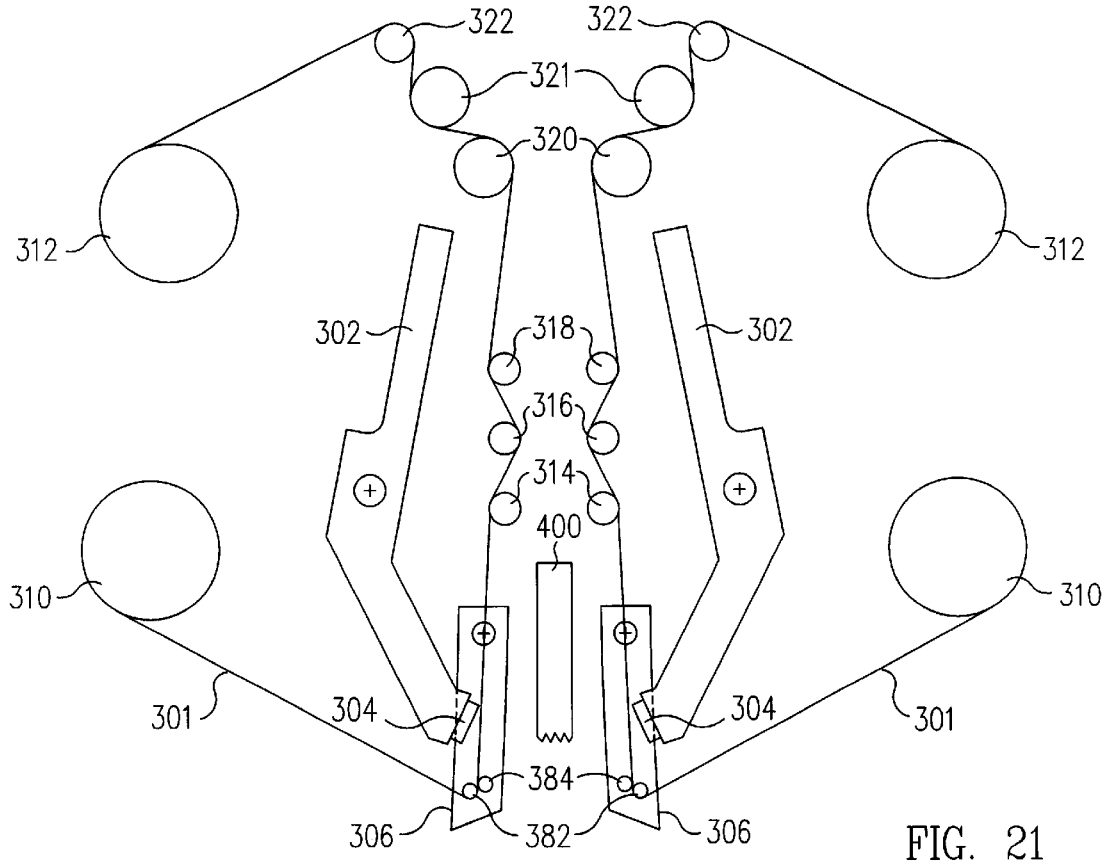

FIGS. 20 and 21 show a simplified top plan view of burnishing apparatus 300 in a closed and an open position, respectively. As shown in FIG. 20, a burnishing tape 301 extends from supply reel 310 between tape guides 382 and 384 on swing arm 306 and around pad arm 302. In the closed position there is little or no tension on burnishing tape 301. The only tension on burnishing tape 301 required in the closed position is used to hold burnishing tape 301 in position on the various guides and rollers. The tip of pad arms 302 have a groove 303 (shown in FIG. 13) which helps center burnishing tape 301 over pads 304. Pads 304 press burnishing tape 301 against the surfaces of disk 400. Burnishing tape 301 then extends over various rollers and guides which prevent burnishing tape 301 from contacting disk 400, except where pads 304 press burnishing tape 301 against disk 400. Burnishing tape 301 is finally taken up at take-up reels 312.

FIG. 21 shows pad arms 302 in an open position with swing arms 306 in a position to provide tension on burnishing tape 301. With pad arms 302 in an open position, pads 304 are no longer pressing burnishing tape 301 against the surfaces of disk 400. Thus, disk 400 may be replaced with a new disk to be burnished. Further, by rotating swing arms 306, tape guide 382 applies tension to burnishing tape 301 such that burnishing tape 301 is not in contact with pads 304. Consequently, burnishing tape 301 may be indexed to a new position without damaging pads 304.

Burnishing tape 301 is indexed by capstan rollers 320 and 321 and the amount of indexing is detected by index guides 322. As shown in FIG. 13, index guides 322 include a sensor to indicate the precise amount that index guides 322 have moved. Thus, the amount burnishing tape 301 is indexed may be carefully controlled. If desired, burnishing tape 301 may be indexed by take-up reels 312. However, as burnishing tape 301 is taken up, the effective radius of the takeup reel 312 will change, making precise indexing of burnishing tape difficult.

Figure 22:
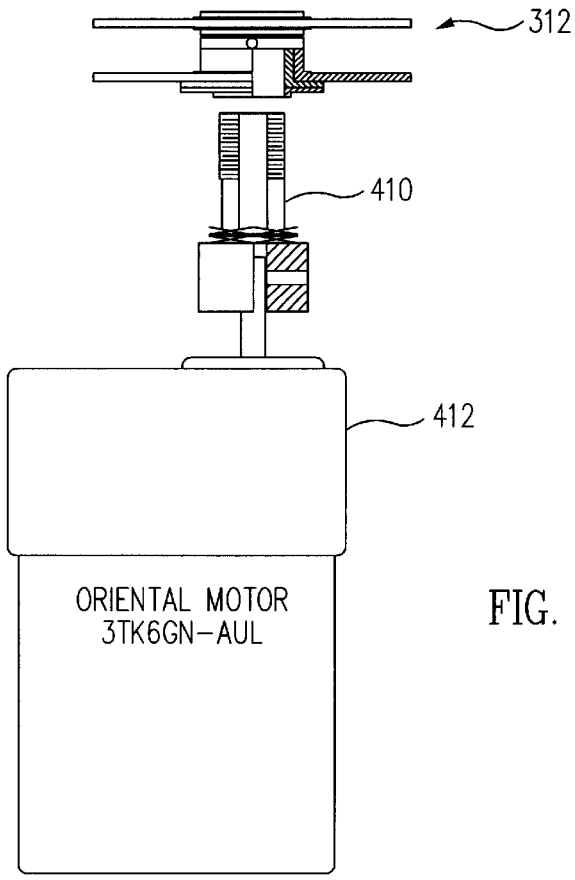
FIG. 22 shows a side view of a motor driven takeup reel.

FIG. 22 shows a side view of a take-up reel 312. As can be seen, take-up reel 312 is mounted on a shaft 410 that is driven by a motor 412, such as a model number 3TK6GN-AUL motor manufactured by Oriental Motor or part number M409M378 manufactured by Globe Motor. Take-up reel 312 is permitted to slip on shaft 410. Thus, as the effect radius of the take-up reel 312 changes due to the accumulation of burnishing tape 301 on take-up reel 312, the amount that take-up reel 312 rotates does not need to be changed.

Figure 23A:
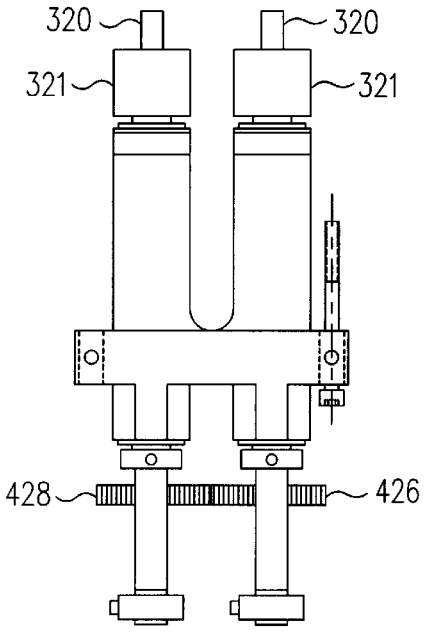
FIGS. 23A and 23B show a front view and a side view, respectively, of a motor driven of capstan rollers used to index the burnishing tape.
Figure 23B:
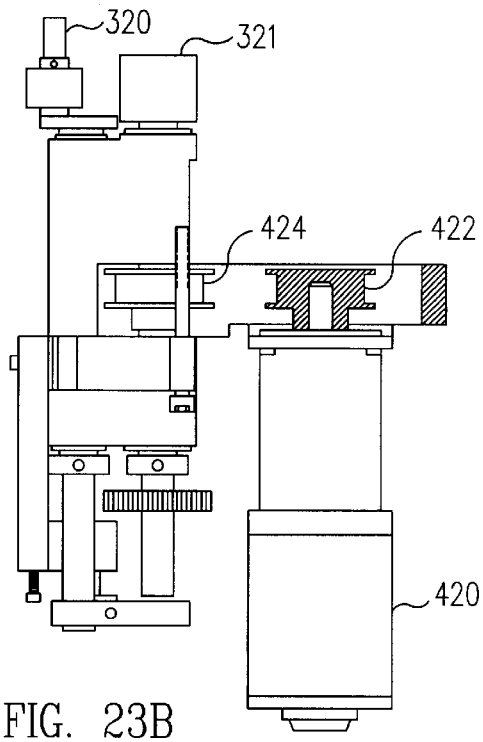

FIGS. 23A and 23B show a front view and a side view of capstan rollers 320 and 321, both sets, and the driving mechanism. A gearmotor 420, such as part number M409M378 manufactured by Globe Motor located in Dayton, Ohio, drives a belt (not shown) around two pulleys 422 and 424. Pulley 424 drives both rollers 321 via gears 426 and 428.

Figure 24:
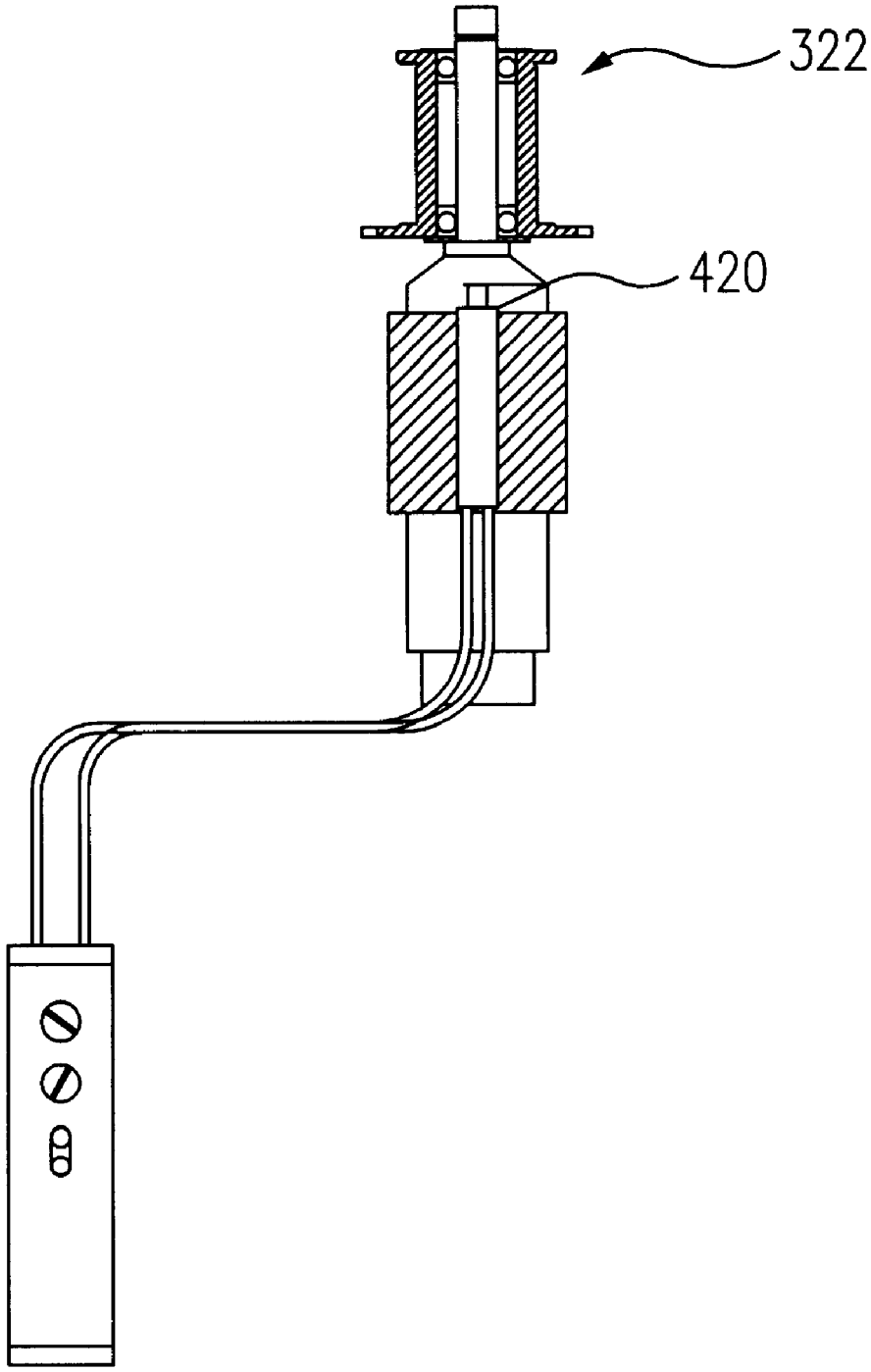
FIG. 24 is a side view of an index guide and sensor used to detect the amount that the burnishing tape has been indexed.

FIG. 24 is a side view of an index guide 322, which freely rotates, along with a sensor 430 used to detect the amount that index guide 322 has rotated and thus how much burnishing tape 301 has been indexed. Sensor 430 may be, for example, may be the type manufactured by Omron located in Japan.

Burnishing apparatus rotates disk 400 at a constant linear velocity (CLV), e.g., 300 meters/minute. The burnishing process is applied from the inside diameter to the outside diameter of disk 400. The desired burnish constant (K), which is e.g., 50, is controlled by the CLV and the time spent at each radial point. Thus, as is well understood by those skilled in the art, the burnishing apparatus 300 must have a differential traverse speed, which is specified by the burnish constant K. Of course, if desired the revolutions per minute (RPMs) of disk 400 may be held constant.

While the present invention has been described in connection with specific embodiments, one of ordinary skill in the art will recognize that various substitutions, modifications and combinations of the embodiments may be made after having reviewed the present disclosure. The specific embodiments described above are illustrative only. Various adaptations and modifications may be made without departing from the scope of the invention. For example, various additional elements, such as sensors may be included in the burnishing apparatus. The spirit and scope of the appended claims should not be limited to the foregoing description.

What is claimed is:

1. An apparatus comprising:

burnishing tape;

burnishing tape indexing mechanism;

at least one pad for pressing said burnishing tape against a surface of a disk to be burnished;

a pad holder upon which said pad is mounted, said pad holder being movable so that said pad presses said burnishing tape against said surface of said disk; and at least one tape guide, said burnishing tape extending over said tape guide and said pad, said tape guide preventing said burnishing tape from contacting said pad when said burnishing tape is indexed by said burnishing tape indexing mechanism.

2. The apparatus of claim 1, wherein said pad holder moves so that said pad presses said burnishing tape against said surface of said disk.

3. The apparatus of claim 2, wherein said pad holder is biased so that said pad presses said burnishing tape against said surface of said disk.

4. The apparatus of claim 3, wherein said pad holder is a first pad arm having a first pad and said apparatus further comprises a second pad arm having a second pad, said first pad arm and said second pad arm being biased so that said first pad and said second pad press burnishing tape against a first surface and a second surface of said disk.

5. The apparatus of claim 4, wherein said first pad arm and said second pad arm movable to be centered on said disk.

6. The apparatus of claim 1, wherein said at least one tape guide applies tension to said burnishing tape when said pad does not press said burnishing tape against said surface of said disk to prevent said burnishing tape from contacting said pad.

7. The apparatus of claim 6, wherein said at least one tape guide releases substantially all the tension from said burnishing tape when said pad presses said burnishing tape against said surface of said disk.

8. The apparatus of claim 1, wherein said tape guide centers said burnishing tape over said pad when said pad holder moves said pad to press said burnishing tape against said surface of said disk so that said pad presses the approximate center of said burnishing tape against said surface of said disk.

9. The apparatus of claim 1, wherein said burnishing tape is indexed over said pad in a direction that is tangential relative to said disk.

10. The apparatus of claim 1, further comprising an arm upon which said at least one tape guide is mounted.

11. The apparatus of claim 8, wherein relative movement in a first direction between said at least one tape guide on said arm and said pad holder applies tension to said burnishing tape when said pad holder removes said pad from contact with said surface of said disk.

12. The apparatus of claim 9, wherein relative movement in a second direction opposite said first direction releases tension on said burnishing tape when said pad holder moves to place said pad in contact with said surface of said disk.

13. The apparatus of claim 8, wherein said arm swings to move said at least one tape guide to apply tension on said burnishing tape.

14. The apparatus of claim 1, wherein said burnishing tape indexing mechanism comprises:

a motor driven take-up reel; and a resistantly rotating supply reel supplying said burnishing tape.

15. The apparatus of claim 14, further comprising a motor driven capstan reel over which said burnishing tape extends, said capstan reel controllably indexes said burnishing tape.

16. A method comprising:

providing a disk between a first pad and a second pad;

rotating said disk;

providing burnishing tape between said first pad and a first surface of said disk and between said second pad and a second surface of said disk;

moving said first pad and said second pad so that said first pad and said second pad press said burnishing tape in contact with said first surface and said second surface of said disk, respectively moving said first pad and said second pad away from said first surface and said second surface of said disk, respectively; and holding said burnishing tape away from said first pad and said second pad when said first pad and said second pad are moved away from said first surface and said second surface of said disk.

17. The method of claim 16, further comprising indexing said burnishing tape when said burnishing tape is held away from said first pad and said second pad.

18. The method of claim 17, further comprising applying tension to said burnishing tape prior to indexing said burnishing tape.

19. The method of claim 18, further comprising releasing tension on said burnishing tape when said first pad and said second pad are moved towards said first surface and said second surface of said disk, respectively.

20. The method of claim 16, wherein said first pad and said second pad are mounted on a first pad holder and a second pad holder, respectively, wherein moving said first pad and said second pad so that said first pad and said second pad press said burnishing tape in contact with said first surface and said second surface of said disk, comprises moving said first pad holder and said second pad holder in unison.

21. The method of claim 16, wherein moving said first pad and said second pad so that said first pad and said second pad press said burnishing tape in contact with said first surface and said second surface of said disk, respectively, further comprises automatically applying equal pressure on said first surface and said second surface.

22. An apparatus comprising:

burnishing tape;

pads to press said burnishing tape against opposing surfaces of a disk to be burnished;

pad holders coupled to said pads; and means for holding said burnishing tape away from said pads when said pads are not pressing said burnishing tape against said opposing surfaces of said disk.

23. The apparatus of claim 22, wherein said means for holding said burnishing tape away from said pads applies tension on said burnishing tape when said burnishing tape is indexed over said pad.

24. The apparatus of claim 23, wherein said means for holding said burnishing tape away from said pads also removes tension from said burnishing tape when said pads press said burnishing tape against said opposing surfaces of said disk.

25. The apparatus of claim 24, wherein said means for holding said burnishing tape away from said pads comprises tape guides mounted on swing arms and movable pad holders, said swing arms and said pad holders move said tape guides and said pads relative to each other to apply tension to said burnishing tape as said burnishing tape is held away from said pads.

26. The apparatus of claim 22, further comprising a means for biasing said pad holders together to apply approximately equal pressure against said surfaces of said disk with said pads.

27. The apparatus of claim 26, further comprising means for automatically centering said pads on said disk.

28. An apparatus comprising:

a disk handling mechanism for rotating a disk;

a first pad and a second pad; and a first pad holder upon which said first pad is mounted and a second pad holder upon which said second pad is mounted, said first pad holder and said second pad holder being configured to hold said first pad and said second pad on opposing sides of said disk mounted on said disk handling mechanism, said first pad holder and second pad holder being biased together such that said first pad and said second pad automatically apply approximately equal pressure to both sides of said disk;

wherein said first pad holder and said second pad holder are linearly movable in unison in a direction perpendicular to the plane of said disk wherein said first pad holder and said second pad holder move linearly to center said first pad and said second pad on said disk.

29. The apparatus of claim 28, further comprising a spring coupled to said first pad holder and said second pad holder, said spring biasing said first pad holder and said second pad holder together such that said first pad and said second pad automatically apply equal pressure to both sides of said disk.

30. The apparatus of claim 28, further comprising a rail coupled to said first pad holder and said second pad holder, said rail permitting said first pad holder and said second pad holder to move towards each other and away from each other, said rail further permitting said first pad holder and said second pad holder to move together in unison in a direction perpendicular to the plane of said disk so that said first pad and said second pad are automatically centered on said disk.

31. The apparatus of claim 30, wherein said first pad holder and said second pad holder move together in unison on said rail while said first pad holder and said second pad holder are coupled to a spring that biases said first pad and said second pad together to automatically apply equal pressure to both sides of said disk.

* * * * *